US007616223B2

(12) United States Patent
Yamamoto et al.

(10) Patent No.: US 7,616,223 B2
(45) Date of Patent: Nov. 10, 2009

(54) THERMAL PRINTHEAD

(75) Inventors: Masaya Yamamoto, Kyoto (JP); Shinobu Obata, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 583 days.

(21) Appl. No.: 11/587,284

(22) PCT Filed: Apr. 26, 2005

(86) PCT No.: PCT/JP2005/007880

§ 371 (c)(1),
(2), (4) Date: Oct. 23, 2006

(87) PCT Pub. No.: WO2005/105461

PCT Pub. Date: Nov. 10, 2005

(65) Prior Publication Data

US 2007/0176998 A1 Aug. 2, 2007

(30) Foreign Application Priority Data

Apr. 28, 2004 (JP) ..... 2004-133970

(51) Int. Cl.
*B41J 2/335* (2006.01)

(52) U.S. Cl. ..... 347/200

(58) Field of Classification Search ..... 347/200–209
See application file for complete search history.

(56) References Cited

U.S. PATENT DOCUMENTS 5,874,983 A * 2/1999 Nagahata et al. ..... 347/200
6,404,453 B1 * 6/2002 Yoshikawa et al. ..... 347/200

FOREIGN PATENT DOCUMENTS

| | | |
|---|---|---|
| JP | 5-218623 | 8/1993 |
| JP | 7-30218 | 1/1995 |
| JP | 7-40569 | 2/1995 |
| JP | 2001-250615 | 9/2001 |

OTHER PUBLICATIONS

Computer-generate translation of JP-05218623, published on Aug. 1993.*
International Search Report mailed Jul. 19, 2005 for corresponding International application PCT/JP2005/007880.

* cited by examiner

*Primary Examiner*—Huan H Tran
(74) *Attorney, Agent, or Firm*—Hamre, Schumann, Mueller & Larson, P.C.

(57) ABSTRACT

A thermal printhead (A) according to the present invention includes a substrate (1) having an obverse surface on which a glaze layer (2) is formed, an electrode (4) formed on the glaze layer (2) and a clip connector (5) attached to an edge of the substrate (1) for connection to an external device and connected to the electrode (4) via solder (8). An input wiring portion (33) as a buffer layer is provided between the glaze layer (2) and the electrode (4), and the input wiring portion (33) protrudes from the electrode (4) at least at an end adjacent to the edge of the substrate (1).

11 Claims, 10 Drawing Sheets

THERMAL PRINTHEAD

TECHNICAL FIELD

The present invention relates to a thermal printhead.

BACKGROUND ART

Some of thermal printheads for performing printing on a recording medium such as thermal paper or a thermal transfer ink ribbon include an external connection member which is utilized for connection to an external device and connected, by soldering, to a substrate provided with a heat-producing resistor and a drive IC.

FIG. 10 is a sectional view showing a principal portion of such a printhead. The thermal printhead X includes a substrate 91 to which a flexible cable 95 as the external connection member is connected. A glaze layer 92 is provided on the substrate 91. On the glaze layer 92, a wiring 93 constituting a circuit is formed. A plurality of electrodes 94 are provided at appropriate portions of the wiring 93. The flexible cable 95 includes a resin substrate 95*a* and a plurality of conductor lines 95*b* formed on the resin substrate. Each of the conductor lines 95*b* is connected directly to a respective one of the electrodes via solder 98.

An end of the flexible cable 95 is covered, along with part of the substrate 91, by a resin layer 97 for preventing detachment from the substrate 91. With this structure, even when stress from the outside or thermal stress in driving is exerted, the separation of the flexible cable 95 from the electrode 94 and the resulting unstable connection between these members can be avoided.

However, since the solder 98 contracts when it cools and solidifies, the contraction force of the solder 98 exerts on the electrode 94 and the glaze layer 92 to produce a stress. Such a stress may cause the detachment of the electrode 94 or the breakage of the glaze layer 92, which may lead to disconnection between each of the conductor lines 95*b* and the drive IC (not shown) connected to the line. Therefore, the reliability of connection of the flexible cable 95 may be deteriorated.

Patent Document 1: JP-A-H07-30218

DISCLOSURE OF THE INVENTION

An object of the present invention, which is conceived under the above-described circumstances, is to provide a thermal printhead which is capable of enhancing the reliability of electrical connection between a substrate and an external connection member.

According to the present invention, there is provided a thermal printhead comprising a substrate having an obverse surface on which a glaze layer is formed, an electrode formed on the glaze layer, and an external connection member attached to an edge of the substrate for connection to an external device and soldered to the electrode. The thermal printhead further comprises a buffer layer interposed between the glaze layer and the electrode, and the buffer layer protrudes from the electrode at least at an end adjacent to the edge of the substrate.

Preferably, the buffer layer protrudes from the entire periphery of the electrode.

Preferably, the buffer layer comprises an Au film.

Preferably, the thermal printhead further comprises a wiring formed on the glaze layer and electrically connected to the electrode, and the buffer layer comprises part of the wiring.

Preferably, the thermal printhead further comprises a wiring protective layer arranged on the wiring and the electrode.

The electrode includes a portion which is not covered by the wiring protective layer, and the buffer layer protrudes from the entire periphery of this portion of the electrode.

Preferably, the electrode includes a pad formed on the wiring, and an upper electrode layer which is formed on the pad, superior in solder wettability to the pad, and smaller in area than the pad.

Preferably, the pad comprises an Ag film, and the upper electrode layer is made of a material obtained by adding an additive for enhancing solder wettability to Ag—Pt, Ag—Pd or Ag.

Preferably, the additive is bismuth oxide.

Preferably, the pad is chamfered on a side closer to the edge of the substrate.

Preferably, the external connection member is covered, along with a portion of the substrate, by a connection portion protective layer at least at a portion soldered to the electrode.

Preferably, the external connection member comprises a clip connector including a plurality of clip pins capable of holding the substrate or a flexible cable.

BEST MODE FOR CARRYING OUT THE INVENTION

Preferred embodiments of the present invention will be described below in detail with reference to the accompanying drawings.

Figure 1:
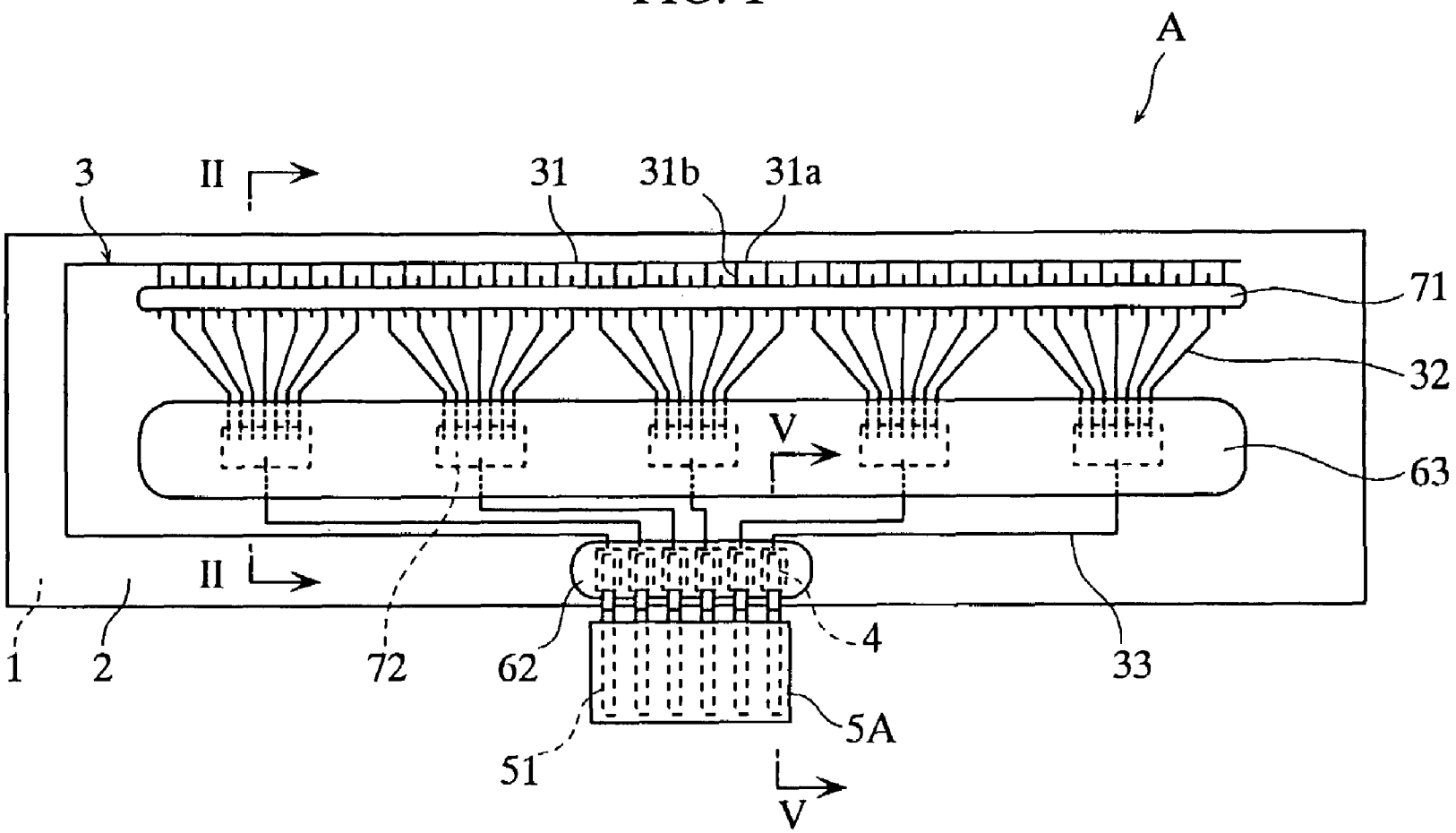
FIG. 1 is a schematic plan view showing a thermal printhead according to a first embodiment of the present invention.

FIGS. 1-5 are schematic plan views showing a thermal printhead according to a first embodiment of the present invention. As shown in FIG. 1, the thermal printhead A includes a substrate 1, a heat-producing resistor 71, drive ICs 72 and a clip connector 5. The clip connector 5 is directly soldered to the substrate 1. It is to be noted that the illustration of the clip connector 5 is omitted in FIG. 4.

The substrate 1 is an insulating substrate made of alumina ceramic material and has an elongated rectangular configuration in plan view as shown in FIG. 1. On the substrate 1, a glaze layer 2 is laminated.

The glaze layer 2 is mainly composed of glass and formed on almost entirety of the obverse surface of the substrate 1. The glaze layer 2 serves as a heat retaining layer. The glaze layer 2 has a smooth obverse surface to enhance the adhesion of the heat-producing resistor 71, the drive ICs 72 and a wiring 3 onto the obverse surface.

The heat-producing resistor 71, the drive ICs 72 and the wiring 3 constituting a circuit are provided on the glaze layer 2.

The wiring 3 comprises e.g. an Au film having a high conductivity and is formed by printing and baking gold resinate. As shown in FIG. 1, the wiring 3 includes a common wiring portion 31, individual wiring portions 32 and input wiring portions 33.

Figure 3:
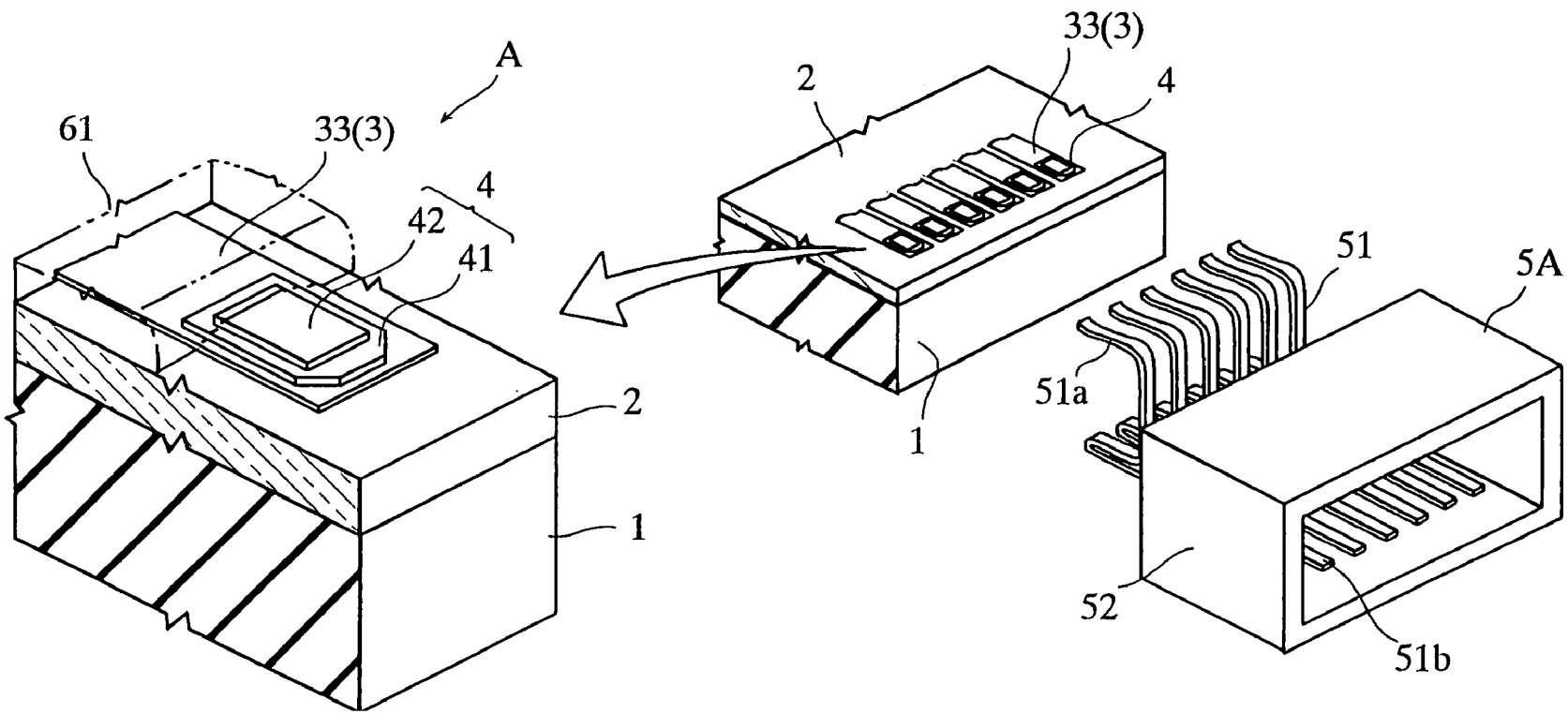
FIG. 3 is a perspective view showing an external connection member of FIG. 1 as enlarged.

The common wiring portion 31 includes a common line portion 31*a* extending longitudinally of the substrate 1 and a plurality of extensions 31 projecting from the common line portion. Each of the individual wiring portions 32 includes an end positioned between adjacent extensions 31*b* and another end connected to an output terminal of the drive IC 72. Each of the input wiring portion 33 includes a first end connected to an input terminal of the drive IC 72 and a second end connected to the clip connector 5. As shown in FIG. 3, an electrode 4 which is to be soldered to the clip connector 5 is provided on the second end of each of the input wiring portions 33.

Figure 4:
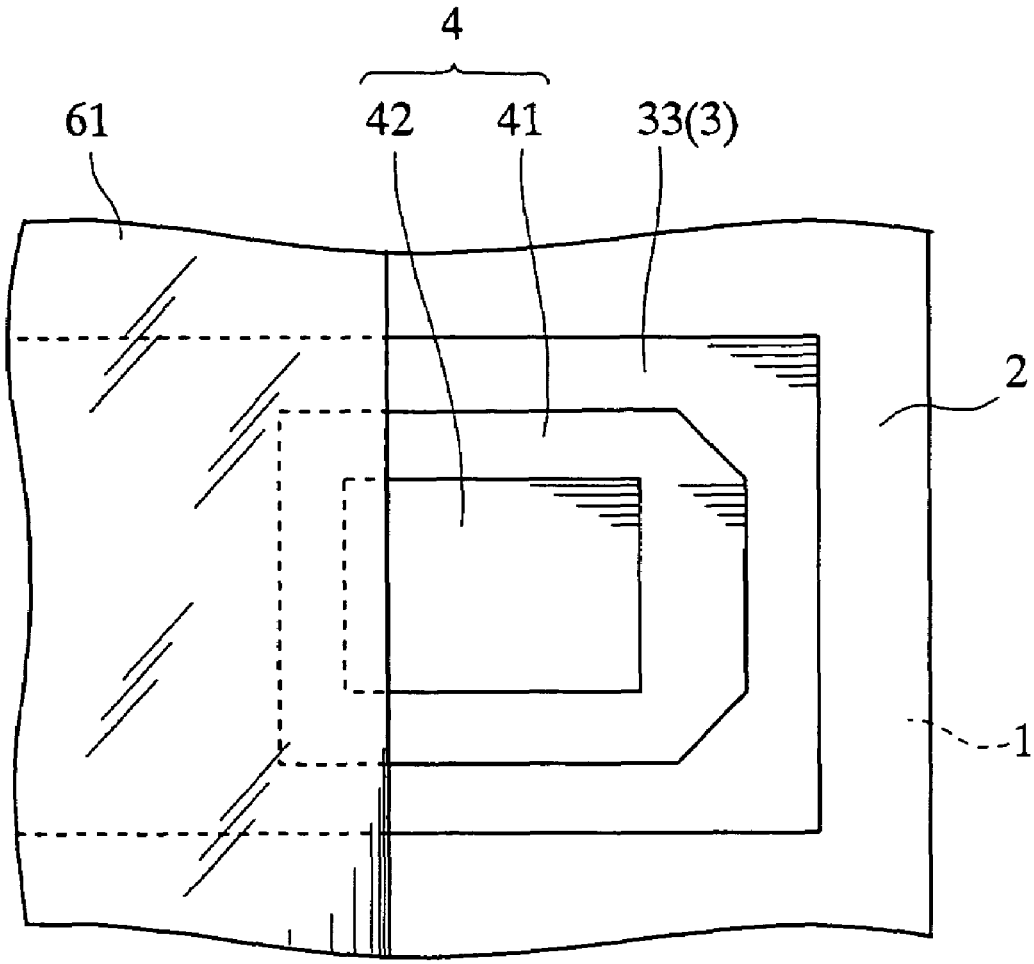
FIG. 4 is a plan view showing a principal portion of an example of thermal printhead according to the present invention.
Figure 5:
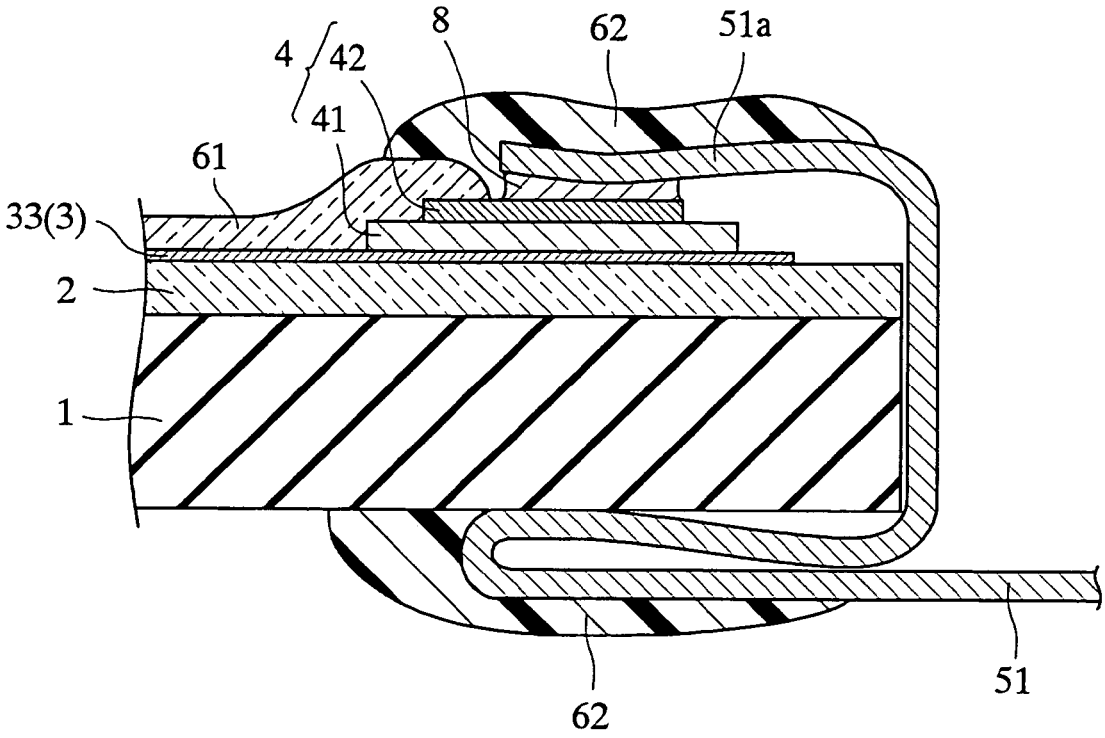
FIG. 5 is a sectional view of a principal portion, which is taken along lines V-V in FIG. 1.

As shown in FIGS. 3-5, each of the electrodes 4 is provided adjacent to a longitudinal edge of the substrate 1 and corresponds to a respective one of clip pins 51 (See FIG. 3) of the clip connector 5. Each of the electrodes 4 includes a pad 41 formed on the input wiring portion 33 and an upper electrode layer 42 formed on the pad 41.

As shown in FIG. 4, the input wiring portion 33 is larger in width than the pad 41. The input wiring portion 33 includes an end which extends beyond an end of the pad 41. In this way, the end of the input wiring portion 33 has an area larger than that of the pad 41 and protrudes from the entire periphery of the pad 41. Thus, the input wiring portion 33 extends out from the entire periphery of the pad 41. In this embodiment, part of the input wiring portion 33 corresponds to the buffer layer in the present invention.

The pad 41 comprises an Ag film and is formed by printing and baking Ag paste. The end of the pad 41 which is closer to the edge of the substrate 1 is chamfered so as not to produce an angle of not more than 90°. Although the pad 41 shown in FIGS. 3 and 4 has a hexagonal planar shape, the pad may have another shape as long as it does not include an angle of not more than 90°. For instance, the pad may be octagonal or elliptical.

The upper electrode layer 42 serves to facilitate soldering of the clip pin 51 of the clip connector 5 and is made of a material which is superior in solder wettability to the pad 41. The upper electrode layer 42 is smaller in area than the pad 41. Specifically, for instance, the upper electrode layer 42 is made of a material obtained by adding an additive for enhancing the solder wettability to Ag—Pt, Ag—Pd or Ag. As the additive, use may be made of bismuth oxide, for example. Bismuth oxide has a function to prevent glass from depositing on a surface. Therefore, by the fusing of the upper electrode layer 42 in soldering, the solder wettability of the upper electrode layer 42 is enhanced.

Figure 2:
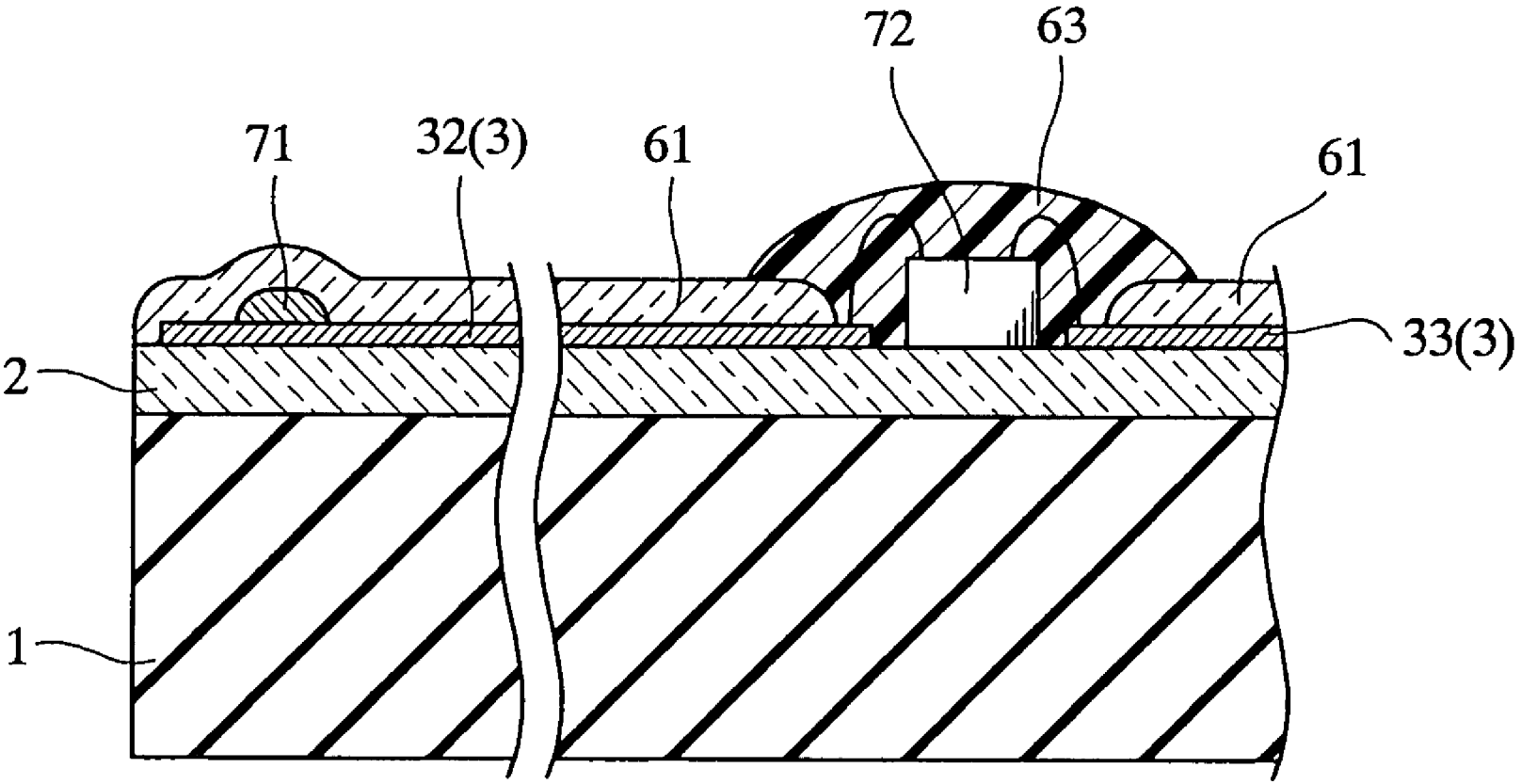
FIG. 2 is a sectional view taken along lines II-II in FIG. 1.

As shown in FIG. 2, a glass layer 61 for protecting the heat-producing resistor 71 and the wiring 3 is formed on the substrate 1. The glass layer 61 is an example of wiring protective layer in the present invention.

As shown in FIG. 1, the heat-producing resistor 71 extends to bridge the extensions 31*b* of the common wiring portion 31 and the individual wiring portions 32. The heat-producing resistor 71 extends longitudinally of the substrate 1 at an end of the substrate in the width direction. The heat-producing resistor 71 is formed by printing and baking e.g. thick film resistor paste containing ruthenium oxide as a conductive component.

The drive IC 72 incorporates a circuit for controlling the driving and heat producing of the heat-producing resistor 71 based on the print data transmitted from an external device (not shown). As shown in FIG. 2, the drive IC 72 is die-bonded to the substrate 1. The input and output terminals of the drive IC 72 are wire-bonded to the individual wiring portion 32 and the input wiring portion 33. As shown in FIGS. 1 and 2, the drive IC 72 is covered by a resin layer 63 for protection from shock and so on.

The clip connector 5 is provided as an external connection member for connecting the thermal printhead A and an external device (not shown). As shown in FIG. 3, the clip connector 5 includes a plurality of clip pins 51 and a socket portion 52 made of resin, for example. Each of the clip pins 51 includes an end provided with a holder portion 51*a* for holding the substrate 1 and another end 51*b* extending into the socket portion 52.

To solder the clip connector 5 to the substrate, the clip connector 5 is so set as to hold a portion of the substrate 1 at which the electrode 4 is formed by the holding portion 51*a* of each clip pin 51. Subsequently, solder paste is applied to a portion around the point of contact between the holder portion 51*a* and the electrode 4. The solder paste is so applied as not to protrude from the upper electrode layer 42. Then, the clip pin 51 is heated with e.g. a hot plate to melt the solder, and then the solder is cooled and solidified.

As shown in FIG. 5, in each of the clip pins 51, the part of the holding portion 51*a* which faces the obverse surface of the substrate 1 and the part which faces the reverse surface of the substrate 1 are covered by a resin layer 62. The resin layer 62 is made of e.g. an ultraviolet setting resin to cover the clip pin 51 along with part of the substrate 1. The resin layer 62 corresponds to a connection portion protective layer in the present invention.

The advantages of the thermal printhead A having the above-described structure will be described below.

As shown in FIG. 5, in the thermal printhead A of this embodiment, each of the clip pins 51 of the clip connector 5 is connected to a respective one of the electrodes 4 via the solder 8. When the solder 8 cools and solidifies, the contraction force acts on the glaze layer 2 from the upper electrode layer 42 and the pad 41 via the input wiring portion 33.

Unlike this embodiment, when the electrode is formed directly on the glaze layer as is in the conventional thermal printhead, the contraction force of the solder acts intensively on a portion of the glaze layer which is bonded to the periphery of the electrode. As a result, a large stress is exerted locally on this portion to cause the detachment of the electrode or the breakage of the glaze layer, whereby the reliability of connection of the clip connector may be deteriorated.

According to this embodiment, however, the contraction force of the solder 8 is exerted on the glaze layer 2 via the input wiring portion 33. Since the end of the input wiring portion 33 has a larger area than that of the pad 41 and protrudes from the entire periphery of the pad 41, the contraction force can be exerted on the glaze layer 2 dispersedly through the part of the input wiring portion 33 which protrudes from the pad 41. Specifically, the electrode 4 contracts in accordance with the contraction of the solder. Without the input wiring portion 33, the contraction force is transmitted from the outer peripheral portion of the pad 41 to the glaze layer 2. However, since the input wiring portion 33 which is larger than the pad 41 throughout the entire periphery of the pad is provided in this embodiment, the contraction force of the solder 8 is transmitted to the glaze layer 2 from the outer peripheral portion of the input wiring portion 33. Since the length of the outer peripheral portion of the input wiring portion is longer than that of the pad 41, a relatively larger area of the glaze layer 2 is pulled so that the contraction force exerted on the glaze layer 2 is dispersed. Therefore, the stress exerted on the glaze layer 2 due to the contraction force can be reduced. Therefore, the detachment of the pad 41 or cracking of the glaze layer 2 can be prevented, whereby the reliability of the connection of the clip connector 5 can be enhanced.

Since the input wiring portion 33 is formed of an Au film, it has excellent ductility and malleability as compared with the pad 41 formed of an Ag film or the upper electrode layer 42 formed of Ag—Pt, for example. Therefore, when the input wiring portion 33 pulls the glaze layer 2 as a result of the contraction of the solder 8, the part of the input wiring portion 33 which protrudes from the pad 41 stretches appropriately, whereby the contraction force exerted on the glaze layer 2 is alleviated. Therefore, the stress on the glaze layer 2 is advantageously reduced.

The cracking of the glaze layer 2 from causes other than the cooling and solidifying of the solder 8 may also be considered. For instance, when the thermal printhead A is driven, the solder 8 and the electrode 4 repeat thermal expansion and thermal contraction in accordance with the power supply to the heat-producing resistor 71. Therefore, the stress exerted on the glaze layer 2 varies. The cracking of the glaze layer 2 is likely to occur when the stress varies greatly. In this embodiment, however, since the input wiring portion 33 protrudes from the pad 41 as noted before, the variation of the stress exerted on the glaze layer 2 can be alleviated.

Although the upper electrode layer 42 of each of the electrodes 4 which is to be directly soldered is smaller in area than the pad 41, the electrode layer has excellent solder wettability. Therefore, the solder bonding strength of the electrode layer with respect to the clip pin 51 is not deteriorated. Moreover, as compared with the structure in which soldering is performed by utilizing the entire region of the pad 41, the area to which solder is applied is small. Accordingly, it is possible to reduce the stress exerted on the electrode 4 and the glaze layer 2 due to the contraction of the solder in cooling and solidifying. Therefore, the detachment of the electrode 4 and the breakage of the glaze layer 2 can be prevented more reliably.

Since the pad 41 is chamfered, the detachment of the electrode 4 can be prevented more reliably. Specifically, when the pad includes an angle of not more than 90°, the contraction force of the solder concentrates on the angle portion, so that the pad is likely to be detached. However, since the pad 41 is chamfered, the contraction force of the solder 8 does not concentrate and can be dispersed to a plurality of portions of the pad 41, whereby the possibility of detachment of the electrode 4 is reduced.

The input wiring portion 33 does not necessarily need to have a uniform width which is larger than that of the pad 41. For instance, the part of the input wiring portion 33 which extends from a position sufficiently spaced from the pad 41 toward the opposite side of the edge of the substrate 1 (the portion which extends left from the left edge of the pad 41 in FIG. 4) may have a width smaller than that of the pad 41. In such a case, the input wiring portion 33 protruding from the entire periphery of the pad 41 can be provided using a smaller amount of Au, which is advantageous for reducing the manufacturing cost.

In this way, with a thermal printhead according to the present invention, the reliability of the electrical connection between the substrate land the clip connector 5 can be enhanced.

Figure 6:
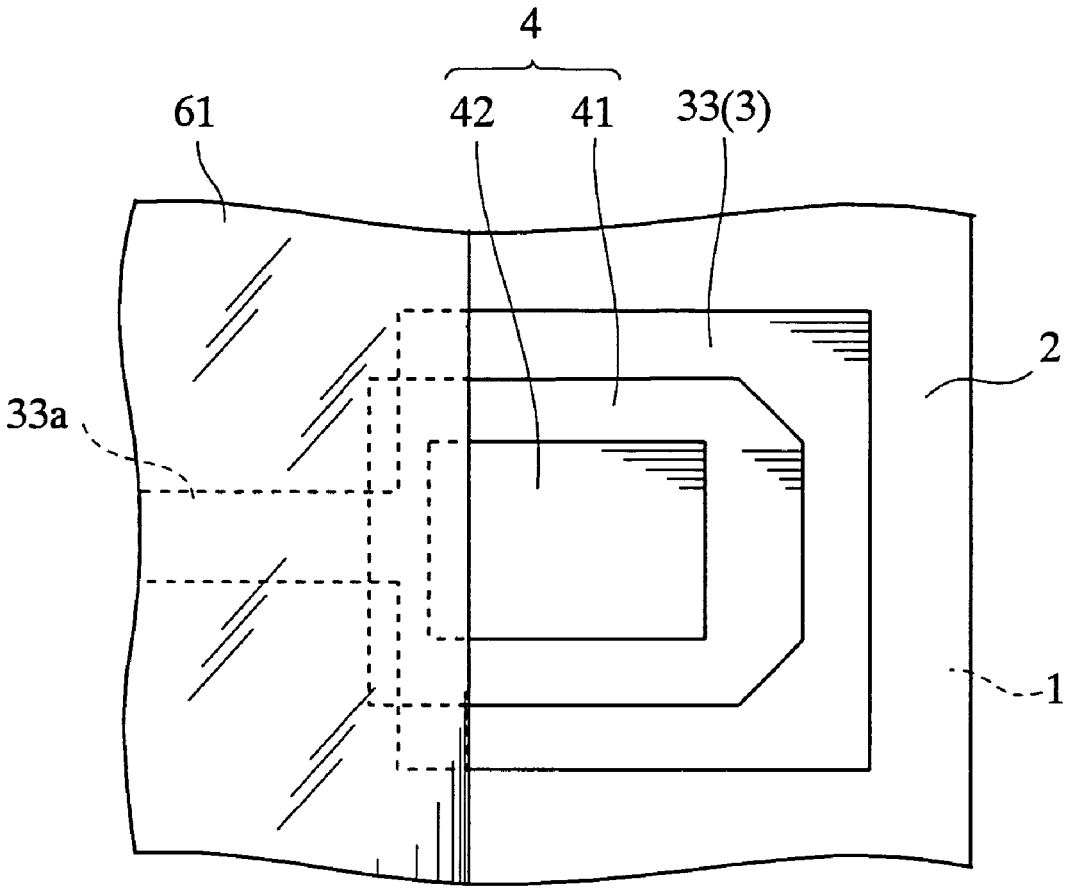
FIG. 6 is a plan view showing a principal portion of a thermal printhead according to a second embodiment of the present invention.

FIG. 6 shows a thermal printhead according to a second embodiment of the present invention. In this figure, the elements which are identical or similar to those of the first embodiment are designated by the same reference signs as those used in the first embodiment.

As shown in FIG. 6, in the thermal printhead according to the second embodiment, the input wiring portion 33 includes a narrow portion 33*a* which is smaller in width than the pad 41 and provided in the region to be covered by the glass layer 61. The narrow portion 33*a* extends to the non-illustrated drive IC. Therefore, under the glass layer 61, the input wiring portion 33 protrudes only from part of the periphery of the pad 41.

To manufacture the thermal printhead according to the second embodiment, the input wiring portion 33, the pad 41 and the upper electrode layer 42 are formed, and then the glass layer 61 is formed. Thereafter, e.g. a clip pin (not shown) is soldered to the upper electrode layer 42.

According to the second embodiment, at a portion of the glaze layer 2 which is not covered by the glass layer 61, stress on the glaze layer is alleviated by the part of the input wiring portion 33 which protrudes from the pad 41, similarly to the foregoing embodiment. On the other hand, the other portions of the glaze layer 2 are covered by the glass layer 61 in soldering e.g. a clip pin (not shown) in the manufacturing process. Therefore, even when the solder (not shown) contracts due to the cooling and solidifying, the contraction force is absorbed also by the glass layer 61, whereby the contraction force exerted on the glaze layer 2 can be alleviated. Therefore, the stress on the glaze layer 2 can be reduced, whereby the detachment of the electrode 4 and the breakage of the glaze layer 2 can be avoided.

Figure 7:
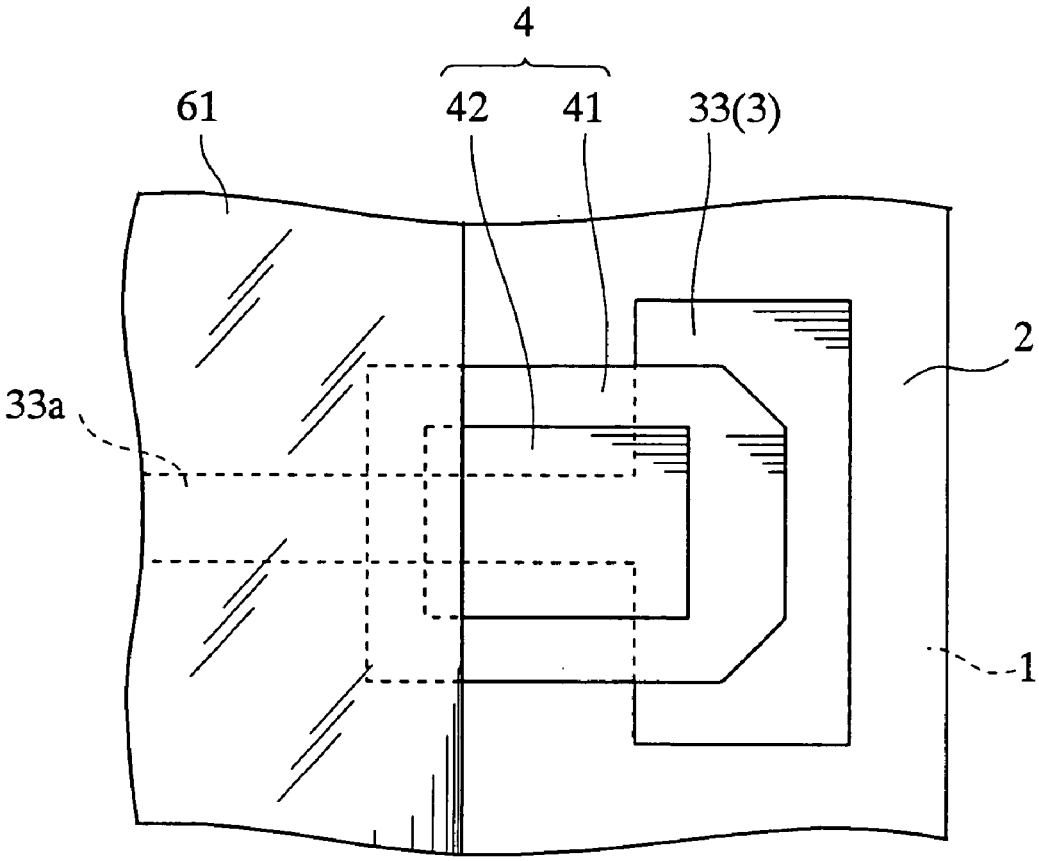
FIG. 7 is a plan view showing a principal portion of a thermal printhead according to a third embodiment of the present invention.

FIG. 7 shows an example of thermal printhead according to a third embodiment of the present invention. In this figure, the elements which are identical or similar to those of the first embodiment are designated by the same reference signs as those used in the first embodiment.

As shown in FIG. 7, the thermal printhead according to the third embodiment differs from that of the second embodiment shown in FIG. 6 in that the narrow portion 33*a* of the input wiring portion 33 is provided also in a region which is not covered by the glass layer 61.

To alleviate the stress exerted on the glaze layer 2 due to e.g. the contraction of solder (not shown), it is preferable that the input wiring portion 33 protrudes from the entire periphery of the pad 41 like the first embodiment shown in FIG. 4 or that the area at which the input wiring portion 33 does not protrude from the pad is protected by the glass layer 61 like the second embodiment shown in FIG. 6.

However, according to the shape of the pad 41 and the upper electrode layer 42 or the manner of the soldering, larger stress may be exerted on a portion of the glaze layer 2 which is bonded to a particular part of the periphery of the pad 41 as compared with the neighboring portions. In such a case, instead of forming the input wiring portion 33 so as to protrude from the entire periphery of the pad 41, the input wiring portion 33 may be so formed as to protrude only at the portion on which larger stress is to be exerted. With such a structure, the stress on the glaze layer 2 can be alleviated. In the third embodiment shown in FIG. 7, it is possible to alleviate the stress exerted on a portion of the glaze layer 2 which is bonded to a portion of the pad 41 which is adjacent to the end thereof.

Figure 8:
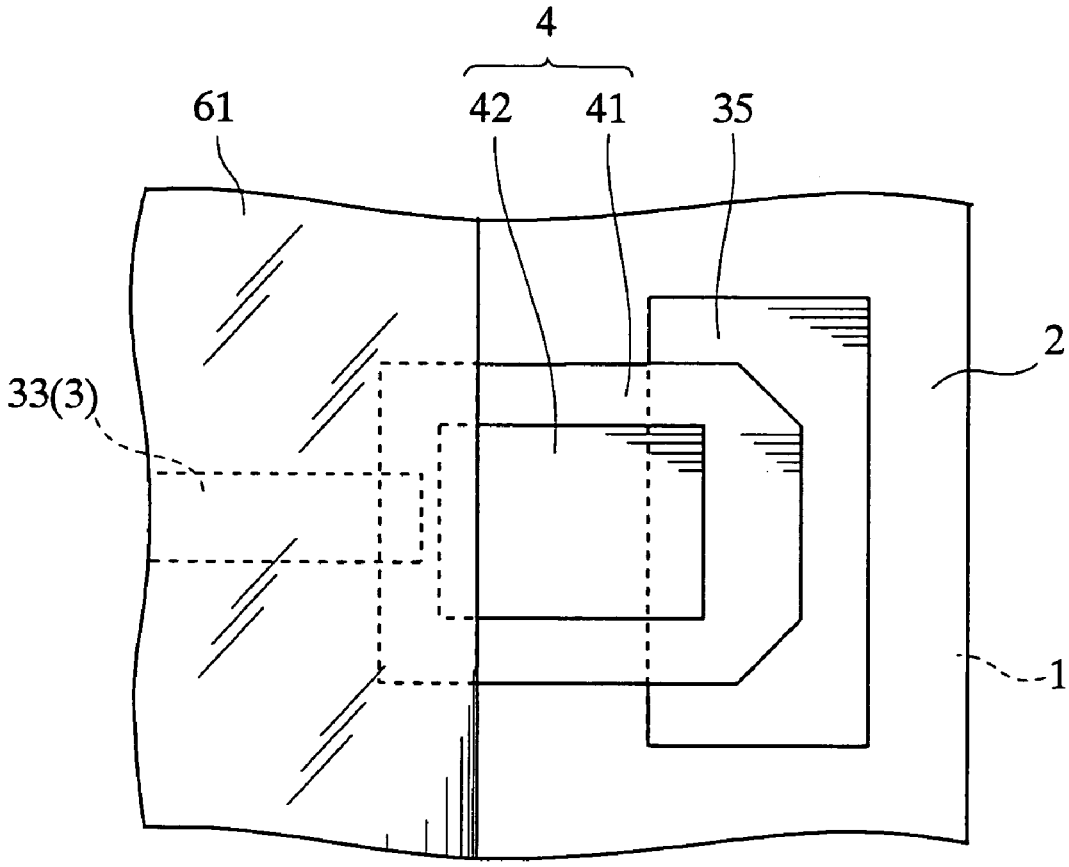
FIG. 8 is a plan view showing a principal portion of a thermal printhead according to a fourth embodiment of the present invention.

FIG. 8 shows an example of thermal printhead according to a fourth embodiment of the present invention. In this figure, the elements which are identical or similar to those of the first embodiment are designated by the same reference signs as those used in the first embodiment.

As shown in FIG. 8, the thermal printhead according to the fourth embodiment differs from the foregoing embodiments in that the thermal printhead includes a buffer layer 35 provided separately from the input wiring portion 33.

According to the fourth embodiment again, the stress on the glaze layer 2 is alleviated. The buffer layer 35 can be efficiently formed at the same time as the input wiring portion 33 by using the same material as that of the input wiring portion 33 which may be Au, for example. Alternatively, the buffer layer 35 may be made of a material which is different from that of the wiring portion 33. For instance, when the buffer layer is made of a material which is superior in ductility and malleability to the material of the input wiring portion 33, the stress on the glaze layer 2 can be further alleviated.

The thermal printhead according to the present invention is not limited to the foregoing embodiments. The specific structure of each part of the thermal printhead according to the present invention can be varied in various ways.

Figure 9:
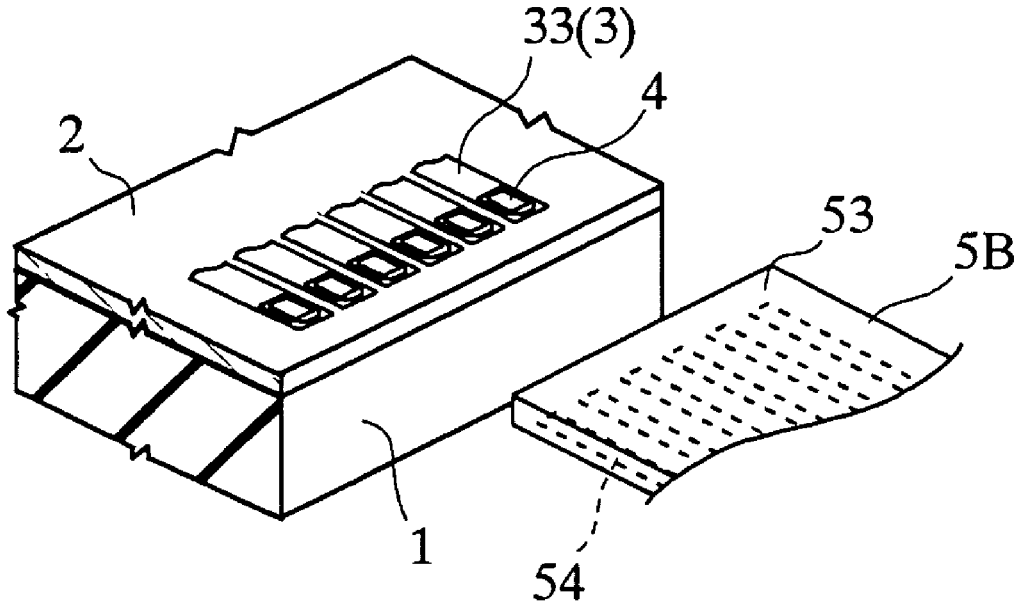
FIG. 9 is a perspective view showing a principal portion of a thermal printhead according to a fifth embodiment of the present invention and showing another example of external connection member.
Figure 10:
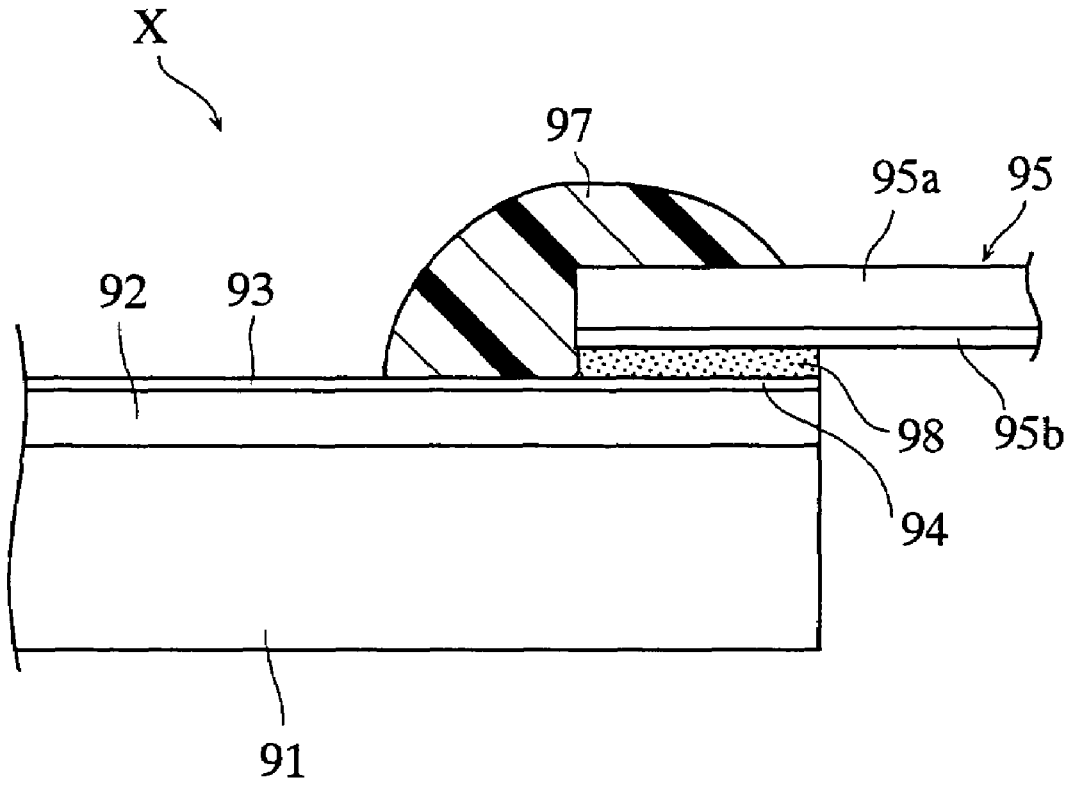
FIG. 10 is a sectional view showing a principal portion of an example of conventional thermal printhead.

For instance, as shown in FIG. 9, a flexible cable 5A may be used as the external connection member instead of the clip connector of the first embodiment shown in FIGS. 1 and 3.

The flexible cable 5B comprises flexible resin substrates 53 made of e.g. a polyimide resin and a plurality of conductor lines 54 formed by etching e.g. a copper foil and arranged between the substrates. Each of the conductor lines 54 of the flexible cable 5A is exposed at an end in the longitudinal direction and soldered to a respective one of the electrodes 4.

Although it is preferable that the buffer layer in the above-described embodiment comprises an Au film, the present invention is not limited thereto. For instance, the buffer layer may comprise a film of a metal other than Au which has excellent ductility and malleability or a resin film. The buffer layer does not necessarily need to be rectangular but may be elliptical, polygonal, ring-shaped or U-shaped as long as it protrudes from an intended part of the periphery of the electrode.

To alleviate the contraction force of the solder, it is preferable that the electrode in the foregoing embodiments has a lamination structure of a pad and an upper electrode layer. However, the present invention is not limited to such a structure, and the electrode may have a single layer structure. Further, the materials of the pad and the upper electrode layer are not limited to those of the foregoing embodiments.

The invention claimed is:

1. A thermal printhead comprising:

a substrate having an obverse surface formed with a glaze layer, an electrode formed on the glaze layer; and an external connection member attached to an edge of the substrate for connection to an external device and soldered to the electrode;

wherein a buffer layer is interposed between the glaze layer and the electrode, the buffer layer protruding from the electrode at least at an end of the electrode that is adjacent to the edge of the substrate.

2. The thermal printhead according to claim 1, wherein the buffer layer protrudes from an entire periphery of the electrode.

3. The thermal printhead according to claim 1, wherein the buffer layer comprises an Au film.

4. The thermal printhead according to claim 1, further comprising a wiring formed on the glaze layer and electrically connected to the electrode;

wherein the buffer layer comprises part of the wiring.

5. The thermal printhead according to claim 4, further comprises a wiring protective layer arranged on the wiring and the electrode;

wherein the electrode includes a portion which is not covered by the wiring protective layer, and the buffer layer protrudes from an entire periphery of the portion of the electrode.

6. The thermal printhead according to claim 4, wherein the electrode includes a pad formed on the wiring, and an upper electrode layer which is formed on the pad, superior in solder wettability to the pad, and smaller in area than the pad.

7. The thermal printhead according to claim 6, wherein the pad comprises an Ag film; and wherein the upper electrode layer is made of a material obtained by adding an additive for enhancing solder wettability to Ag—Pt, Ag—Pd or Ag.

8. The thermal printhead according to claim 7, wherein the additive is bismuth oxide.

9. The thermal printhead according to claim 6, wherein the pad is chamfered on a side closer to the edge of the substrate.

10. The thermal printhead according to claim 1, wherein the external connection member is covered, along with a portion of the substrate, by a connection portion protective layer at least at a portion soldered to the electrode.

11. The thermal printhead according to claim 1, wherein the external connection member comprises a clip connector including a pluralily of clip pins capable of holding the substrate or a flexible cable.

* * * * *